US005272032A

United States Patent [19]

Cowdery et al.

[11] Patent Number: 5,272,032

[45] Date of Patent: Dec. 21, 1993

[54] MULTIACTIVE ELECTROPHOTOGRAPHIC ELEMENTS CONTAINING ELECTRON TRANSPORT AGENTS

[75] Inventors: J. Robin Cowdery, Webster; Michael R. Detty, Rochester; David B. Engel, Rochester; Ralph H. Young, Rochester, all of N.Y.

[73] Assignee: Eastman Kodak Company, Rochester, N.Y.

[21] Appl. No.: 167

[22] Filed: Jan. 4, 1993

[51] Int. Cl.[5] ..... G03G 5/047

[52] U.S. Cl. ..... 430/59; 430/58; 430/83

[58] Field of Search ..... 430/58, 59

[56] References Cited

U.S. PATENT DOCUMENTS

| | | | |
|---|---|---|---|
| 3,041,166 | 6/1962 | Bardeen . | |
| 3,165,405 | 1/1965 | Hoesterey . | |
| 3,394,001 | 7/1968 | Makino . | |
| 3,615,414 | 10/1971 | Light . | |
| 3,679,405 | 7/1972 | Makino et al. . | |
| 3,725,058 | 4/1973 | Hayashi et al. . | |
| 4,175,960 | 11/1979 | Berwick et al. | 430/58 |
| 4,281,115 | 7/1981 | Baumann | 542/441 |
| 4,284,699 | 8/1981 | Berwick et al. | 430/96 |
| 4,474,865 | 10/1984 | Ong et al. | 430/58 |
| 4,514,481 | 4/1985 | Scozzafava et al. | 430/58 |
| 4,546,059 | 10/1985 | Ong et al. | 430/59 |
| 4,578,334 | 3/1986 | Borsenberger et al. | 430/59 |
| 4,609,602 | 9/1986 | Ong et al. | 430/58 |
| 4,666,802 | 5/1987 | Hung et al. | 430/58 |
| 4,701,396 | 10/1987 | Hung et al. | 430/58 |
| 4,719,163 | 1/1988 | Staudenmayer et al. | 430/58 |
| 4,840,860 | 6/1989 | Staudenmayer et al. | 430/59 |
| 4,869,984 | 9/1989 | Kung et al. | 430/58 |
| 4,869,985 | 9/1989 | Kung et al. | 430/58 |
| 4,913,996 | 4/1990 | Kung et al. | 430/59 |
| 4,997,737 | 3/1991 | Bugner et al. | 430/58 |
| 5,019,473 | 5/1991 | Nguyen et al. | 430/58 |
| 5,034,293 | 7/1991 | Rule et al. | 430/58 |
| 5,039,585 | 8/1991 | Rule et al. | 430/59 |
| 5,055,368 | 10/1991 | Nguyen et al. | 430/78 |

FOREIGN PATENT DOCUMENTS

| | | |
|---|---|---|
| 02-082259 | 3/1990 | Japan . |
| 03-012657 | 1/1991 | Japan . |
| 03-132763 | 6/1991 | Japan . |

*Primary Examiner*—Roland Martin

*Attorney, Agent, or Firm*—Robert Luke Walker

[57] ABSTRACT

The invention provides a multiactive electrophotographic element comprising an electrically conductive substrate, a charge generation layer, and a charge transport layer, wherein the charge transport layer contains an electron transport agent having the structure:

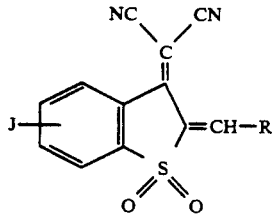

(I)

wherein J is H, Cl, Br, alkyl, alkoxy, aryl, or aryl further substituted with halo or alkyl; and wherein R is styryl, aryl, or heteroaryl in which the hetero atom is S or O, each of which R is unsubstituted or further substituted with alkyl, halo, alkoxy, nitro, hydroxy, cyano, trifluoromethyl, alkylsulfonyl, arylsulfonyl, alkoxycarbonyl, amino, alkylamino, dialkylamino, arylamino, or alkylarylamino.

Such an element exhibits a good combination of electrophotographic performance properties.

10 Claims, No Drawings

MULTIACTIVE ELECTROPHOTOGRAPHIC ELEMENTS CONTAINING ELECTRON TRANSPORT AGENTS

FIELD OF THE INVENTION

This invention relates to multiactive electrophotographic elements, i.e., elements comprising an electrically conductive substrate, a charge generation layer, and a charge transport layer. More particularly, the invention relates to the inclusion of certain electron transport agents in charge transport layers of such elements to yield elements that exhibit a good combination of electrophotographic performance properties.

BACKGROUND

In electrophotography an image comprising a pattern of electrostatic potential (also referred to as an electrostatic latent image), is formed on a surface of an electrophotographic element comprising at least an insulative photoconductive layer and an electrically conductive substrate. The electrostatic latent image is usually formed by imagewise radiation-induced discharge of a uniform potential previously formed on the surface. Typically, the electrostatic latent image is then developed into a toner image by bringing an electrographic developer into contact with the latent image. If desired, the latent image can be transferred to another surface before development.

In latent-image formation the imagewise discharge is brought about by the radiation-induced creation of pairs of negative-charge electrons and positive-charge holes, which are generated by a material (often referred to as a charge generation material) in the electrophotographic element in response to exposure to the imagewise actinic radiation. Depending upon the polarity of the initially uniform electrostatic potential and the type of materials included in the electrophotographic element, typically, either the holes or the electrons that have been generated migrate toward the charged surface of the element in the exposed areas and thereby cause the imagewise discharge of the initial potential. What remains is a non-uniform potential constituting the electrostatic latent image.

Among the various known types of electrophotographic elements are those generally referred to as multiactive elements (also sometimes called multilayer or multi-active-layer elements). Multiactive elements are so named, because they contain at least two active layers, at least one of which is capable of generating electron/hole pairs in response to exposure to actinic radiation and is referred to as a charge generation layer (hereinafter sometimes also referred to as a CGL), and at least one of which is capable of accepting and transporting charges generated by the charge generation layer and is referred to as a charge transport layer (hereinafter sometimes also referred to as a CTL). Such elements typically comprise at least an electrically conductive layer, a CGL, and a CTL. Either the CGL or the CTL is in electrical contact with both the electrically conductive layer and the remaining CGL or CTL. The CGL comprises at least a charge generation material; the CTL comprises at least a charge transport material (a material which readily accepts holes and/or electrons generated by the charge generation material in the CGL and facilitates their migration through the CTL in order to cause imagewise electrical discharge of the element and thereby create the electrostatic latent image); and either or both layers may additionally comprise a film-forming polymeric binder.

Many multiactive electrophotographic elements currently in use are designed to be charged initially with a negative polarity and to be developed with a positively charged toner material. Usually, the arrangement of layers in such elements has the CGL situated between the CTL and the electrically conductive layer, so that the CTL is the uppermost of the three layers, and its outer surface bears the initial negative charge (although in some cases there may be a protective overcoat over the CTL which bears the initial charge). Such elements contain a charge transport material in the CTL which facilitates the migration of positive holes (generated in the CGL) toward the negatively charged CTL surface in imagewise exposed areas in order to cause imagewise discharge. Such material is often referred to as a hole transport material. In elements of that type a positively charged toner material is then used to develop the remaining imagewise unexposed portions of the negative-polarity potential (i.e., the latent image) into a toner image. Because of the wide use of negatively charging elements, considerable numbers and types of positively charging toners have been fashioned and are available for use in electrographic developers.

However, for some applications of electrophotography it is more desirable to be able to develop the surface areas of the element that have been imagewise exposed to actinic radiation, rather than those that remain imagewise unexposed. For example, in electrophotographic printing of alphanumeric characters it is more desirable to be able to expose the relatively small percentage of surface area that will actually be developed to form visible alphanumeric toner images, rather than waste energy exposing the relatively large percentage of surface area that will constitute undeveloped background portions of the final image. In order to accomplish this while still employing widely available high quality positively charging toners, it is necessary to use an electrophotographic element that is designed to be positively charged. Thus, positive toner can then be used to develop the exposed surface areas (which will have relatively negative electrostatic potential after exposure and discharge, compared with the unexposed areas, where the initial positive potential will remain).

A multiactive electrophotographic element can be designed to be charged positively initially and still have the layer arrangement wherein the CGL is situated between the CTL and the electrically conductive layer. However, such an element must contain an adequate electron transport agent (i.e., a material which adequately facilitates the migration of photo-generated electrons toward the positively charged insulative element surface) in its CTL. While many materials having good hole-transport properties have been fashioned for use in electrophotographic elements, unfortunately, relatively few materials are known to provide good electron transport properties in electrophotographic elements.

A number of chemical compounds having electron transport properties are described, for example, in U.S. Pat. Nos. 4,175,960; 4,514,481; 4,474,865; 4,546,059; 4,227,551; 4,609,602; 4,869,984; 4,869,985; 4,913,996; 4,997,737; 5,034,293; and 5,039,585.

Some prior art electron transport agents do not perform the electron transporting function very well, especially under certain conditions or when included in certain types of electrophotographic elements.

Some of such elements containing prior art electron transport agents exhibit poor charge acceptance. The phrase, "charge acceptance," refers to the capability of the element to be charged initially to the desired level of uniform potential at the beginning of each cycle of its normal operation (a cycle being the sequence of operation comprising initially uniformly charging the element, exposing the element imagewise to actinic radiation to form the electrostatic latent image, optionally developing the electrostatic latent image into a toner image with an electrographic developer, and erasing the remaining potential on the element to prepare it for the next cycle of operation). "Poor charge acceptance" means that the element has a relatively poor capability of being initially charged to the desired level of potential.

Also some prior art electron transport agents cause an undesirably high rate of discharge of the electrophotographic element before it is exposed to actinic radiation (often referred to as high dark decay).

Some multiactive elements containing known electron transport agents exhibit photosensitivity that is lower than desirable. The term, "photosensitivity" (sometimes referred to as "electrophotographic speed") refers to the amount of incident actinic radiant energy to which the element must be exposed in order to achieve the desired degree of discharge of the initial potential to which the element was initially charged. The lesser the amount of radiant energy required for such discharge is, the higher is the photosensitivity, and vice versa.

Some known electron transport agents provide relatively poor (i.e., low) electron mobility in CTL's. The term, "electron mobility," refers to the velocity with which the electron transport agent will transport electrons (that were generated in the CGL) through the CTL to cause imagewise discharge of the initial uniform potential on the element. Higher electron mobility enables the photogenerated electrons to traverse the CTL and cause the discharge in a shorter period of time. High electron mobility enables use of an element, for example, in a high speed copier employing high-intensity, short-duration imagewise exposure (commonly also referred to as flash exposure), wherein the time it will take for the element to properly discharge, and, thus, the length of the period needed between the end of the exposure step and the beginning of the toner image development step, is determined by the level of electron mobility within the element. The higher the mobility is, the shorter is the necessary waiting period between exposure and development, and the greater is the number of copies that can be made in a given amount of time.

Also, some known electron transport agents comprise compounds known to be toxic or carcinogenic (e.g., 2,4,7-trinitrofluorenone).

In general, there are simply not enough known relatively good electron transport agents available to choose from in order to have the flexibility to be able to develop electrophotographic elements that photodischarge by means of electron transport and that can be optimized for use in various different situations (e.g., where an element is desired to contain certain charge generating materials, sensitizers, binders, conducting layers, etc., or where it is desired to charge the element with a certain polarity or level of charge, to subject the element to imagewise exposure at a particular wavelength or intensity of radiation, to use the element in copiers that require it to photodischarge in a certain time or require it to be able to hold a charge in darkness for a particular period of time before imagewise exposure, etc.).

Thus, there is a continuing need for new electron transport agents for multiactive electrophotographic elements, in order to have the flexibility to meet the above-noted needs, namely, to be able to fashion multiactive elements that can discharge by means of electron transport and can exhibit good combinations of performance properties such as good charge acceptance, dark decay, photosensitivity, and electron mobility.

SUMMARY OF THE INVENTION

The present invention meets the above-noted needs by providing a multiactive electrophotographic element comprising an electrically conductive substrate, a charge generation layer, and a charge transport layer, wherein the charge transport layer contains an electron transport agent having the structure:

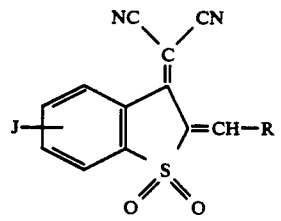

(I)

wherein J is H, Cl, Br, alkyl, alkoxy, aryl, or aryl further substituted with halo or alkyl; and wherein R is styryl, aryl, or heteroaryl in which the hetero atom is S or O, each of which R is unsubstituted or further substituted with alkyl, halo, alkoxy, nitro, hydroxy, cyano, trifluoromethyl, alkylsulfonyl, arylsulfonyl, alkoxycarbonyl, amino, alkylamino, dialkylamino, arylamino, or alkylarylamino.

The chemical compounds that serve as electron transport agents in the CTL's of elements in accordance with the invention were not previously known to be useful for that purpose. They afford the flexibility to be able to provide elements in accordance with the invention that photodischarge by means of electron transport and that can be optimized for use in various different situations. Generally, elements provided by the invention exhibit combinations of good performance characteristics such as good charge acceptance, dark decay, photosensitivity, and electron mobility.

DESCRIPTION OF PREFERRED EMBODIMENTS

As used herein (for example, in regard to the description of Structure (I) above), the term, "alkyl", is intended to mean $C_1$–$C_{10}$ alkyl, the term, "aryl", is intended to mean $C_6$–$C_{14}$ aryl, and the term, "heteroaryl", is intended to mean $C_4$–$C_{12}$ heteroaryl, unless otherwise specified.

The only essential differences of elements of this invention from known multiactive electrophotographic elements lie in the nature of the charge transport materials contained in the charge transport layers. In virtually all other respects in regard to composition, proportions, preparation, and use, the inventive elements can be the same as other multiactive electrophotographic elements described in the prior art. For detailed description of those aspects that elements of the invention can have in common with other known multiactive elements, see, for example, U.S. Pat. Nos. 3,041,166; 3,165,405; 3,394,001; 3,615,414; 3,679,405; 3,725,058; 4,175,960; 4,284,699; 4,514,481; 4,578,334; 4,666,802; 4,701,396; 4,719,163; 4,840,860; 5,019,473; and 5,055,368, the disclosures of which are hereby incorporated herein by reference. A partial listing of layers and components that the elements of this invention can have in common with known multiactive electrophotographic elements includes, for example: electrically conductive layers and supports bearing such conductive layers; charge generation layers; charge transport layers in addition to those in accordance with the present invention; optional subbing layers, barrier layers, protective overlayers and screening layers; polymeric binders useful for forming any of the previously mentioned layers; charge generation materials capable of generating electron/hole pairs in response to exposure to actinic radiation; other charge transport materials; and optional leveling agents, surfactants, plasticizers, sensitizers, contrast-control agents, and release agents.

The compounds of Structure (I) employed as electron transport agents in CTL's of multiactive electrophotographic elements in accordance with the invention are known compounds (although not known to be useful as electron transport agents in electrophotographic elements) and can be prepared by known synthetic methods therefor, for example, as described in U.S. Pat. No. 4,281,115.

Some examples of specific Structure (I) compounds that have been prepared for use in elements in accordance with the invention are listed in Table I below (with reference to J and R of Structure (I) above).

TABLE I

| Compound | J— | —R |
|---|---|---|
| I-A | H— | 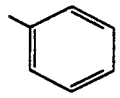 |
| I-B | H— | 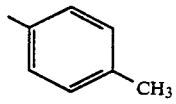 |
| I-C | H— | 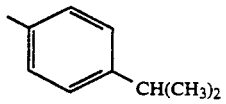 |
| I-D | H— | 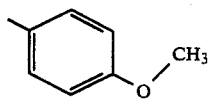 |
| I-E | H— | 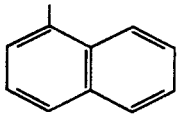 |

TABLE I-continued

| Compound | J— | —R |
|---|---|---|
| I-F | H— | 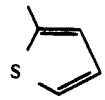 |
| I-G | H— | 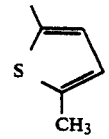 |
| I-H | H— | 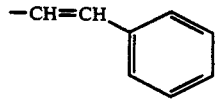 |
| I-J | H— | 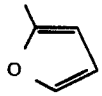 |
| I-K | H— | 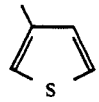 |
| I-L | H— | 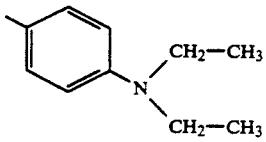 |
| I-M | H— | 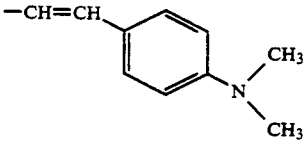 |
| I-N | H— | 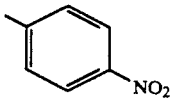 |
| I-O | H— | 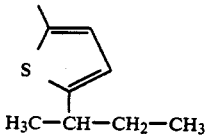 |
| I-P | $H_3C$— | 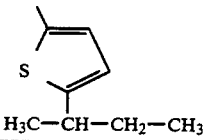 |

As with prior multiactive elements, multiactive electrophotographic elements in accordance with the present invention typically comprise at least an electrically conductive layer, a CGL, and a CTL. Either the CGL or the CTL is in electrical contact with both the electrically conductive layer and the remaining CGL or CTL. The CGL contains at least a charge generation material; the CTL contains at least a charge transport agent; and either or both layers can optionally contain an electrically insulative film-forming polymeric binder. In multiactive elements of the invention the charge transport agent is an electron transport agent comprising one or more of the chemical compounds of Structure (I) described above.

Structure (I) compounds may also be useful as electron transport agents in electrophotographic elements referred to as single-active-layer or single layer elements. Single-active-layer elements are so named, because they contain only one layer that is active both to generate and to transport charges in response to exposure to actinic radiation. Such elements typically comprise at least an electrically conductive layer in electrical contact with a photoconductive layer. In single-active-layer elements, the photoconductive layer contains a charge generation material to generate electron/hole pairs in response to actinic radiation and an electron transport material, comprising one or more of the chemical compounds of Structure (I) described above, which is capable of accepting electrons generated by the charge generation material and transporting them through the layer to effect discharge of the initially uniform electrostatic potential. The photoconductive layer is electrically insulative, except when exposed to actinic radiation, and sometimes contains an electrically insulative polymeric film-forming binder, which may itself be the charge generating material or may be an additional material which is not charge-generating. In either case the electron transport agent is dissolved or dispersed as uniformly as possible in the binder film.

In preparing single-active-layer electrophotographic elements, the components of the photoconductive layer, including any desired addenda, can be dissolved or dispersed together in a liquid and can be coated on an electrically conductive layer or support. The liquid is then allowed or caused to evaporate from the mixture to form the permanent layer containing from about 10 to about 70 percent (by weight) of the electron transport agent and from about 0.01 to about 50 weight percent of the charge generating material. Included among many useful liquids for this purpose are, for example, aromatic hydrocarbons such as benzene, toluene, xylene and mesitylene; ketones such as acetone and butanone; halogenated hydrocarbons such as methylene chloride; trichloroethane, chloroform and ethylene chloride; ethers, including ethyl ether and cyclic ethers such as tetrahydrofuran; other solvents such as acetonitrile and dimethylsulfoxide; and mixtures thereof.

In preparing multiactive electrophotographic elements of the invention, the components of the CTL can be similarly dissolved or dispersed in such a liquid coating vehicle and can be coated on either an electrically conductive layer or support or on a CGL previously similarly coated or otherwise formed on the conductive layer or support. In the former case a CGL is thereafter coated or otherwise formed (e.g., by vacuum-deposition) on the CTL. The CTL will usually contain from about 10 to about 70 weight percent of the electron transport agent, although concentrations outside that range may be found to be useful in some cases.

The CTL of a multiactive electrophotographic element can also, in accordance with the present invention, be applied by other means such as vacuum deposition to a CGL or a conductive support. A vacuum-deposited CTL can contain 100 weight percent of the electron transport agent and can be very thin, with a thickness of about 1 to about 10 μm, preferably about 2 to about 4 μm.

Various electrically conductive layers or supports can be employed in electrophotographic elements of the invention, such as, for example, paper (at a relative humidity above 20 percent); aluminum-paper laminates; metal foils such as aluminum foil, zinc foil, etc.; metal plates such as aluminum, copper, zinc, brass and galvanized plates; vapor deposited metal layers such as silver, chromium, vanadium, gold, nickel, aluminum and the like; and semiconductive layers such as cuprous iodide and indium tin oxide. The metal or semiconductive layers can be coated on paper or conventional photographic film bases such as poly(ethylene terephthalate), cellulose acetate, etc. Such conducting materials as chromium, nickel, etc. can be vacuum-deposited on transparent film supports in sufficiently thin layers to allow electrophotographic elements prepared therewith to be exposed from either side.

Any charge generation material can be utilized in elements of the invention. Such materials include inorganic and organic (including monomeric, metallo-organic and polymeric organic) materials, for example, zinc oxide, lead oxide, selenium, phthalocyanine, perylene, arylamine, polyarylalkane, and polycarbazole materials, among many others.

When solvent-coating a photoconductive layer of a single-active-layer element or a CGL and/or CTL of a multiactive element of the invention, a film-forming polymeric binder can be employed. The binder may, if it is electrically insulating, help to provide the element with electrically insulating characteristics. It also is useful in coating the layer, in adhering the layer to an adjacent layer, and when it is a top layer, in providing a smooth, easy to clean, wear-resistant surface.

The optimum ratio of charge generation or charge transport material to binder may vary widely depending on the particular materials employed. In general, useful results are obtained when the amount of active charge generation and/or charge transport material contained within the layer is within the range of from about 0.01 to about 90 weight percent, based on the dry weight of the layer.

Representative materials which can be employed as binders in charge generation and charge transport layers are film-forming polymers having a fairly high dielectric strength and good electrically insulating properties. Such binders include, for example, styrene-butadiene copolymers; vinyl toluene-styrene copolymers; styrene-alkyd resins; silicone-alkyd resins; soya-alkyd resins; vinylidene chloride-vinyl chloride copolymers; poly(vinylidene chloride); vinylidene chloride-acrylonitrile copolymers; vinyl acetate-vinyl chloride copolymers; poly(vinyl acetals), such as poly(vinyl butyral); nitrated polystyrene; poly(methylstyrene); isobutylene polymers; polyesters, such as poly[ethylene-co-alkylenebis(alkyleneoxyaryl)phenylenedicarboxylate]; phenolformaldehyde resins; ketone resins; polyamides; polycarbonates; polythiocarbonates; poly[ethylene-co-isopropylidene-2,2-bis(ethyleneoxyphenylene)terephthalate]; copolymers of vinyl haloacrylates and vinyl acetate such as poly(vinyl m-bromobenzoate-co-vinyl acetate); chlorinated poly(olefins), such as chlorinated poly(ethylene); and polyamides, such poly[1,1,3-trimethyl-3-(4'-phenyl)-5-indane pyromellitimide].

Binder polymers should provide little or no interference with the generation or transport of charges in the layer. Examples of binder polymers which are especially useful include bisphenol A polycarbonates and polyesters such as poly[4,4'-(2-norbornylidene)diphenylene terephthalate-co-azelate].

As previously mentioned, CGL's and CTL's in elements of the invention can also optionally contain other addenda such as leveling agents, surfactants, plasticizers, sensitizers, contrast-control agents, and release agents, as is well known in the art.

Also as previously mentioned, elements of the invention can contain any of the optional additional layers known to be useful in electrophotographic elements in general, such as, e.g., subbing layers, overcoat layers, barrier layers, and screening layers.

The following preparations and examples are presented to further illustrate some specific electrophotographic elements of the invention and chemical compounds useful as electron transport agents therein.

In all of the preparations below, compound structures were confirmed by nuclear magnetic resonance spectroscopy, infrared spectroscopy, field desorption mass spectrometry, and, in some cases, ultraviolet-visible spectroscopy.

Preparation of 3-Oxo-2-carboethoxy-2,3-dihydrobenzo[b]thiophene (Compound X)

Ethyl benzoylacetate (100.0 g, 0.52 mol) was added dropwise over a period of 1.5 h under vigorous mechanical stirring to fuming $H_2SO_4$ 37% (500.0 g) cooled at 5° C. in an ice bath. After the addition was complete the reaction mixture was stirred for 1.5 h and then added to 1000 g of ice. The solid product was collected by filtration and washed with cold water (30 ml) to give 132.1 g (85%) of Compound X as a pale yellow solid:melting point 138°–140° C.

Preparation of 3-Oxo-2,3-dihydrobenzo[b]thiophene-1,1-dioxide (Compound Y)

A suspension of Compound X (130.0 g, 0.51 mol) in 350 ml of 10% aqueous $H_2SO_4$ was heated at reflux for 6 h (until gas evolution ceased). The reaction mixture was cooled and a white solid precipitated, which was collected by filtration and washed in cold water (30 ml). The product was recrystallized from ethanol to give 83.8 g (90%) of Compound Y as a white crystalline solid:melting point 133°–134° C.

Preparation of 3-Dicyanomethylene-2,3-dihydrobenzo[b]thiophene-1.1-dioxide (Compound d Z)

A solution of malononitrile (38.0 g, 0.58 mol) in 170 ml of ethanol was added to a suspension of Compound Y (82.0 g, 0.45 mol) in 100 ml of ethanol. The slurry was stirred mechanically while a solution of acetic acid (2 ml), piperidine (0.7 ml) and ethanol (15 ml) was added dropwise. The resulting mixture was heated at 60° C. for 8–12 h and then cooled to ambient temperature. The solid product was collected by filtration and washed with cold ethanol. Recrystallization from ethanol yielded 91.7 g (78%) of Compound Z as a pale-red solid:melting point 198°–199° C.

Preparation A (Compound I-A of Table I)

Benzaldehyde (0.0022 mol) was added dropwise to a suspension of Compound Z (0.46 g, 0.0020 mol) in 3–4 ml of ethanol. The resulting mixture was stirred while heated at 60° C. for 6–12 h. The reaction mixture was cooled and the colored dye was collected by filtration and washed with cold ethanol. Recrystallization from acetonitrile yielded 0.54 g (85%) of Compound I-A:melting point 214°–216° C.

Preparations B-P (Compounds I-B through I-P of Table I)

Compounds I-B through I-P of Table I, above, were prepared as in Preparation A, above, starting with Compound Z (or the appropriate J-substituted Compound Z) and the appropriate R-aldehyde (J and R refer to the symbols used in the illustration of Structure (I), above).

In all of the following examples and comparative examples of electrophotographic elements, the performance of the elements in regard to charge acceptance was excellent; i.e., in all cases the elements were successfully charged to the desired level of initial uniform potential.

EXAMPLE 1 AND COMPARATIVE EXAMPLE A

Dark Decay and Photosensitivity

A multiactive electrophotographic element in accordance with the invention (Example 1) was prepared as follows.

A conductive-layer-coated support was prepared by vacuum-depositing a thin conductive layer of aluminum onto a 178 micrometer thickness of poly(ethylene terephthalate) film and then overcoating the conductive layer by electron beam evaporation with a 500-angstrom-thick electrical barrier layer of silicon dioxide.

A charge generation layer (CGL) was prepared by dispersing the charge generation material, titanyl tetrafluorophthalocyanine (described more extensively in U.S. Pat. No. 4,701,396), in a solution of a polymeric binder, comprising a polyester formed from 4,4'-(2-norbornylidene)diphenol and terephthalic acid:azelaic acid (40:60 molar ratio), and a small amount of DC-510® siloxane coating aid (from Dow Corning) in dichloromethane (the weight ratio of charge generation material:binder being 2:1), ball-milling the dispersion for 60 hours, diluting with a mixture of dichloromethane (DCM) and 1,1,2-trichloroethane (TCE) (to yield a final DCM:TCE weight ratio of 80:20) to achieve suitable coating viscosity, coating the dispersion onto the barrier layer, and drying off the solvent to yield a CGL of 0.6 micrometer thickness.

A charge transport layer (CTL) comprising 100% electron transport agent was formed by vacuum deposition of Compound I-A of Table I at a rate of 15–30 angstroms/second to a thickness of 2.0 micrometers onto the outer surface of the CGL.

For purposes of comparison a multiactive element outside the scope of the invention (Comparative Example A) was prepared in the same manner as in Example 1, except that, instead of Compound I-A of Table I, above, 4-dicyanomethylene-2-phenyl-6-(4-tolyl)-4H-thiopyran-1,1-dioxide (described more extensively in Preparation A of U.S. Pat. No. 5,039,585, and hereinafter referred to as "PTS") was employed as the electron transport agent in the CTL.

To measure photosensitivity of each element, the element was electrostatically corona-charged to an initial positive potential ($V_o$) (usually 70 or 80 volts) and then exposed to actinic radiation (radiation having peak intensity at a wavelength of 680 nm, to which the charge generation material in the element is sensitive, in order to generate electron/hole pairs) at a rate of 2.0 ergs/cm2s, in an amount sufficient to photoconductively discharge 50% of the initial voltage.

Photosensitivity was measured in terms of the amount of incident actinic radiant energy (expressed in ergs/cm$^2$) needed to achieve 50 percent discharge of the initial voltage. The lower the amount of radiation needed to achieve the desired degree of discharge, the higher is the photosensitivity of the element, and vice versa.

To determine dark decay properties of the elements, the rate of dissipation of the initial voltage (expressed in V/s, i.e., volts per second) was determined while the element remained in darkness (i.e., before any exposure to actinic radiation). This was accomplished by measuring the initial voltage and the voltage remaining on the element after 2 seconds in darkness and dividing the difference by 2. The lower the rate of discharge in darkness, the better is the dark decay property of the element, i.e., the better is the element's ability to retain its initial potential before exposure.

The results are presented in Table II, below, wherein "Electron transport agent", refers to the chemical compound incorporated in the CTL of an electrophotographic element to serve as an electron transport agent, and the compound is identified with reference to its designation in Table I above (or identified as "PTS" in the case of the compound employed in the Comparative Example). "$V_o$" refers to the uniform positive potential (in volts) on the element, after it was charged by corona-charging and after any dark decay, such potential having been measured just prior to any exposure of the element to actinic radiation. "DD" refers to the rate of dark decay of the element, prior to exposure to actinic radiation, measured in volts per second (V/s) as described above. "E(50% $V_o$)" refers to the amount of incident actinic radiant energy (expressed in ergs/cm$^2$) that was needed to discharge the element to a level of 50% of $V_o$.

TABLE II

| Example | Electron Transport Agent | $V_o$ (V) | DD (V/s) | E(50% $V_o$) (ergs/cm$^2$) |
|---|---|---|---|---|
| Comparative A | PTS | 80 | <0.1 | 16.4 |
| Comparative A | PTS | 70 | <0.1 | 21.2 |
| 1 | I-A | 80 | 2.5 | 7.7 |
| 1 | I-A | 70 | 2.5 | 7.8 |

The data in Table II show that the element of the invention exhibited good charge acceptance, dark decay, and photosensitivity, comparable to the element of the Comparative Example.

EXAMPLES 2 AND 3 AND COMPARATIVE EXAMPLES B AND C

Dark Decay and Photosensitivity

Multiactive elements of the invention (Examples 2 and 3) were prepared. The conductive layer-coated support, barrier layer, and CGL were prepared the same as in Example 1.

A coating solution for forming a charge transport layer (CTL) was then prepared comprising 10 weight percent solids dissolved in dichloromethane. The solids comprised the electron transport agent, Compound I-C of Table I, a polymeric binder comprising a polyester formed from 4,4'-(2-norbornylidene)diphenol and terephthalic acid:azelaic acid (40:60 molar ratio), and a small amount of DC-510® siloxane coating aid (from Dow Corning). The concentration of electron transport agent was different for each Example, as noted in Table III. The solution was then coated onto the CGL and dried to form the CTL on the CGL. The combined thickness of CGL and CTL was about 6 micrometers.

For purposes of comparison, multiactive elements (Comparative Examples B and C) outside the scope of the invention were prepared in the same manner as the elements of Examples 2 and 3, respectively, except that PTS was employed as the electron transport agent, instead of Compound I-C.

Dark decay and photosensitivity of the elements were determined in the same manner as in Example 1, except that the elements were charged to an initial positive potential ($V_o$) of 300 volts and were exposed to actinic radiation of 830 nm wavelength at a rate of 2.0 erg/cm$^2$s.

The results are presented in Table III, below, wherein the common column headings have the same meanings as in Table II, and "Wt %" refers to the percent by weight of electron transport agent employed, based on the total weight of solids included in the solution used to coat the CTL of the element.

TABLE III

| Example | Electron Transport Agent | Wt % | $V_o$ (V) | DD (V/s) | E(50% $V_o$) (ergs/cm$^2$) |
|---|---|---|---|---|---|
| Comparative B | PTS | 60 | 300 | 6.5 | 5.9 |
| Comparative C | PTS | 45 | 300 | 3.0 | 6.1 |
| 2 | I-C | 60 | 300 | 2.2 | 14.7 |
| 3 | I-C | 45 | 300 | 2.9 | 13.1 |

The data in Table III show that the elements of the invention exhibited good charge acceptance, dark decay, and photosensitivity, of the same order of magnitude as the elements of the comparative examples.

EXAMPLES 4–15 AND COMPARATIVE EXAMPLES D AND E

Dark Decay and Photosensitivity

Multiactive elements of the invention (Examples 4 through 15) were prepared in the same manner as in Examples 2 and 3, except that various different compounds from Table I and different concentrations thereof were employed as the electron transport agent in the CTL.

For purposes of comparison, multiactive elements outside the scope of the invention (Comparative Examples D and E) were also prepared, in the same manner as the elements of Comparative Examples B and C, except that different concentrations of PTS were employed as the electron transport agent.

Dark decay and photosensitivity of the elements were determined in the same manner as in Example 2, except that in some of the examples the elements were charged to an initial positive potential ($V_o$) of 500 volts, and in the examples wherein the CTL contained 40 or 60 Wt % electron transport agent, the actinic radiation was applied at a rate of 1.7 ergs/cm$^2$s. The results are presented in Table IV, below, wherein the column headings have the same meanings as in Table III.

TABLE IV

| Example | Electron Transport Agent | Wt % | $V_o$ (V) | DD (V/s) | E(50% $V_o$) (ergs/cm$^2$) |
|---|---|---|---|---|---|
| Comparative D | PTS | 20 | 300 | 5 | 7.1 |

TABLE IV-continued

| Example | Electron Transport Agent | Wt % | $V_o$ (V) | DD (V/s) | E(50% $V_o$) (ergs/cm$^2$) |
|---|---|---|---|---|---|
| 4 | I-B | 20 | 300 | 4 | 15.5 |
| 5 | I-C | 20 | 300 | 4 | 15.4 |
| 6 | I-D | 20 | 300 | 2 | 18.6 |
| 7 | I-E | 20 | 300 | 6 | 18.1 |
| 8 | I-F | 20 | 300 | 4 | 21.6 |
| 9 | I-G | 20 | 300 | 8 | 15.9 |
| 4 | I-B | 20 | 500 | 7 | 15.1 |
| 5 | I-C | 20 | 500 | 6 | 16.9 |
| 6 | I-D | 20 | 500 | 9 | 18.9 |
| 7 | I-E | 20 | 500 | 17 | 22.3 |
| 8 | I-F | 20 | 500 | 10 | 19.6 |
| 9 | I-G | 20 | 500 | 16 | 16.2 |
| Comparative E | PTS | 40 | 300 | 2 | 7.0 |
| 10 | I-C | 40 | 300 | 1 | 13.4 |
| 11 | I-D | 40 | 300 | 1 | 12.7 |
| 12 | I-O | 40 | 300 | 4 | 20.0 |
| 13 | I-P | 40 | 300 | 2.5 | 15.1 |
| 10 | I-C | 40 | 500 | 10 | 12.1 |
| 11 | I-D | 40 | 500 | 11 | 10.5 |
| 14 | I-O | 60 | 300 | 3.5 | 14.6 |
| 15 | I-P | 60 | 300 | 3 | 14.5 |

The data in Table IV show that the elements of the invention exhibited good charge acceptance, dark decay, and photosensitivity, of the same order of magnitude as the elements of the comparative examples.

It should also be noted that another element (not listed in Table IV) outside the scope of the invention was prepared in the same manner as in Comparative Example D, except that the compound employed as electron transport agent, which was also outside the scope of Structure (I), had the structure (referring to Structure (I) for convenience) wherein J- is H-, and -R is 2-pyrrolyl. This element, after being initially charged to a uniform potential of 300 volts, exhibited no voltage discharge when exposed to actinic radiation, thus indicating that the compound did not function as an electron transport agent.

EXAMPLES 2,4,5,6,8,10. AND 11

Electron Mobility

Electron mobility performance of multiactive elements of the invention prepared as in Examples 2,4,5,6,8,10, and 11 was determined as follows.

Multiple gold dots, each approximately 5mm in diameter and 500 angstroms thick, were deposited on the surface of the CTL of approximately 6-cm$^2$ samples of the elements. To establish contact with the conductive aluminum layer, a carbon-containing conductive lacquer was applied to the edge of the samples, and the dried lacquered edge was pressed into contact with a steel plate. Contact to the gold dot was made by an indium-coated phosphor bronze tine. The thickness of the samples was determined by measuring the area of the gold dot and the capacitance between it and the aluminum layer, assuming a relative dielectric constant of 3.0.

Time-of-flight measurements were made by connecting a sample to a high-voltage power supply via the phosphor bronze tine and via the steel plate through a current-sensing resistor to ground. Any current through the sample produced a proportional voltage across the resistor, which was amplified and recorded. The record was then analyzed by computer. Flash illumination was provided by a flash lamp, a filter passing light of wavelengths of at least 530 nm, and neutral-density filters to adjust light intensity.

During application of a voltage, the sample was irradiated for approximately 1 microsecond. The resulting photocurrent typically exhibited an early peak and rapid decline to a plateau, followed by a shoulder and fall-off towards zero. The shoulder was identified as the time required for electrons to cross the sample, i.e., the transit time. The velocity of the electrons was computed as the thickness of the layer divided by the transit time. Electron mobility was determined by dividing this velocity by the electric field strength created by the applied voltage.

Results are presented in Table V, below, wherein "Field" means the electric field strength applied through the layers, expressed in units of $10^5$ V/cm, "Electron mobility" means the velocity at which photogenerated electrons passed through the CTL per given field strength, expressed in units of $10^{-9}$ cm$^2$/Vs, and the other column heading have the same meanings as in the previous tables.

TABLE V

| Example | Electron Transport Agent | Wt % | Field ($10^5$ V/cm) | Electron Mobility ($10^{-9}$ cm$^2$/Vs) |
|---|---|---|---|---|
| 4 | I-B | 20 | 3.0 | 5.9 |
| 4 | I-B | 20 | 4.0 | 7.9 |
| 4 | I-B | 20 | 5.0 | 10.4 |
| 4 | I-B | 20 | 6.0 | 13.3 |
| 5 | I-C | 20 | 3.0 | 3.2 |
| 5 | I-C | 20 | 4.0 | 3.9 |
| 5 | I-C | 20 | 5.0 | 6.1 |
| 5 | I-C | 20 | 6.0 | 7.9 |
| 6 | I-D | 20 | 2.0 | 1.8 |
| 6 | I-D | 20 | 3.0 | 2.7 |
| 6 | I-D | 20 | 4.0 | 4.0 |
| 6 | I-D | 20 | 6.0 | 7.0 |
| 8 | I-F | 20 | 3.0 | 1.0 |
| 8 | I-F | 20 | 4.0 | 1.5 |
| 8 | I-F | 20 | 5.0 | 2.0 |
| 8 | I-F | 20 | 6.0 | 2.7 |
| 10 | I-C | 40 | 1.0 | 8.3 |
| 10 | I-C | 40 | 2.0 | 19 |
| 10 | I-C | 40 | 4.0 | 44 |
| 10 | I-C | 40 | 6.0 | 74 |
| 11 | I-D | 40 | 2.0 | 23 |
| 11 | I-D | 40 | 3.0 | 32 |
| 11 | I-D | 40 | 4.0 | 50 |
| 11 | I-D | 40 | 5.0 | 65 |
| 11 | I-D | 40 | 6.0 | 81 |
| 2 | I-C | 60 | 1.0 | 94 |
| 2 | I-C | 60 | 3.0 | 350 |
| 2 | I-C | 60 | 4.0 | 520 |
| 2 | I-C | 60 | 5.0 | 810 |

The data in Table V show that elements in accordance with the invention exhibit good electron mobility, especially elements containing 40 Wt % of Compound I-C (Example 10) or of Compound I-D (Example 11) or 60 Wt % of Compound I-C (Example 2).

The invention has been described in detail with particular reference to certain preferred embodiments thereof, but is should be appreciated that variations and modifications can be effected with the spirit and scope of the invention.

What is claimed is:

1. A multiactive electrophotographic element comprising an electrically conductive substrate, a charge generation layer, and a charge transport layer, wherein the charge transport layer contains an electron transport agent having the structure:

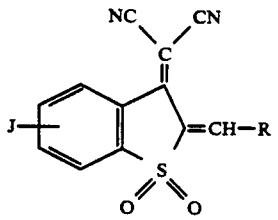

wherein J is H, Cl, Br, alkyl, alkoxy, aryl, or aryl further substituted with halo or alkyl; and wherein R is styryl, aryl, or heteroaryl in which the hetero atom is S or O, each of which R is unsubstituted or further substituted with alkyl, halo, alkoxy, nitro, hydroxy, cyano, trifluoromethyl, alkylsulfonyl, arylsulfonyl, alkoxycarbonyl, amino, alkylamino, dialkylamino, arylamino, or alkylarylamino.

2. The electrophotographic element of claim 1, wherein J is H, and R is phenyl, p-tolyl, p-isopropylphenyl, p-methoxyphenyl, 1-naphthyl, 2-thienyl, or 2-(5-methyl)thienyl.

3. The electrophotographic element of claim 1, wherein the charge transport layer comprises a polymeric film containing the electron transport agent.

4. The electrophotographic element of claim 3, wherein J is H and R is p-tolyl, p-isopropylphenyl, p-methoxyphenyl, 1-naphthyl, 2-thienyl, or 2-(5-methyl)thienyl.

5. The electrophotographic element of claim 3, wherein the polymeric film comprises a polyester formed from 4,4'-(2-norbornylidene)diphenol and terephthalic and azelaic acids.

6. The electrophotographic element of claim 1, wherein the charge transport layer comprises a vacuum deposited layer of the electron transport agent.

7. The electrophotographic element of claim 6, wherein J is H and R is phenyl.

8. The electrophotographic element of claim 1, wherein the charge generation layer comprises a polymeric film containing a charge generation material.

9. The electrophotographic element of claim 8, wherein the charge generation material comprises titanyl tetrafluorophthalocyanine.

10. The electrophotographic element of claim 8, wherein the polymeric film comprises a polyester formed from 4,4'-(2-norbornylidene)diphenol and terephthalic and azelaic acids.

* * * * *